US006550417B2

(12) United States Patent
Hendershot

(10) Patent No.: US 6,550,417 B2
(45) Date of Patent: Apr. 22, 2003

(54) BOOKMARK

(76) Inventor: Joe Hendershot, 1844 Narvick Ct, Eagen, MN (US) 55122

( * ) Notice: Subject to any disclaimer, the term of this patent is extended or adjusted under 35 U.S.C. 154(b) by 0 days.

(21) Appl. No.: 09/811,855

(22) Filed: May 14, 2001

(65) Prior Publication Data

US 2002/0166496 A1 Nov. 14, 2002

(51) Int. Cl.[7] ..... B42D 9/00

(52) U.S. Cl. ..... 116/234; 116/235; 281/42; 283/37

(58) Field of Search ..... 116/234, 235, 116/240; D19/34; 281/42; 283/36, 37, 38, 39, 40, 41, 42; 273/292, 304, 307; D21/376

(56) References Cited

U.S. PATENT DOCUMENTS 404,782 A * 6/1889 Foster ..... 273/304
869,302 A * 10/1907 Healy ..... 273/303
1,228,607 A * 6/1917 Sawyer ..... 273/304
1,241,049 A * 9/1917 Stevens ..... 283/36
1,420,265 A * 6/1922 Kieckhefer ..... 116/235
D69,279 S * 1/1926 Melikov ..... D19/1
4,570,940 A * 2/1986 Lamle ..... 273/296
4,901,665 A * 2/1990 Carlin ..... 116/235
5,311,835 A * 5/1994 Knowles ..... 116/235
5,524,898 A * 6/1996 Pavlovic ..... 273/292
5,632,225 A * 5/1997 Krasner ..... 116/235
6,021,735 A * 2/2000 Kamen ..... 116/234
6,149,155 A * 11/2000 Hoyt et al. ..... 273/292

* cited by examiner

*Primary Examiner*—Diego Gutierrez
*Assistant Examiner*—Tania C. Courson
(74) *Attorney, Agent, or Firm*—Paul H. Gallagher

(57) ABSTRACT

A single card having a pair of icons on each side thereof, distributed longitudinally. Each icon includes a representation of an open book showing facing pages and a dot indicating upper or lower locations on a page of the book. A letter R or L indicates whether the location is on the right or left page. A modified form includes a double arrangement for use in the case when the pages of the book have two columns on each page.

4 Claims, 2 Drawing Sheets

BOOKMARK

FIELD OF THE INVENTION

The invention resides in the field of marking a place in a book where the reader left off reading so that he may quickly and easily find that place later, to continue reading.

SUMMARY OF THE INVENTION

A broad object of the invention is to provide a bookmark of the foregoing general character, that is extremely simple, and easy to use for its intended purpose.

It is inexpensive to manufacture.

It is attractive in appearance, and although it is simple, it is very effective in providing a large number of detail indications for finding locations in facing pages in a book.

Another feature, incorporated in an alternative form, is a double set of indications arranged in a simple pattern for indicating a larger number of locations in a complex book.

BRIEF DESCRIPTIONS OF THE INDIVIDUAL FIGURES OF THE DRAWINGS

DETAILED DESCRIPTION OF THE DRAWINGS

Figure 1:
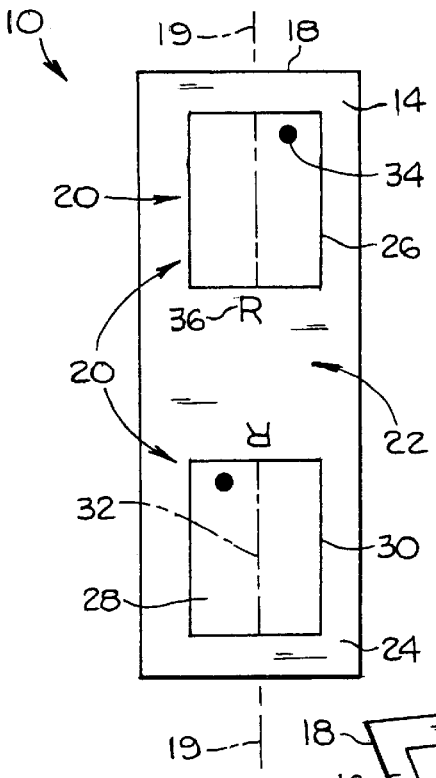
FIG. 1 is a face view of a first side of the bookmark.
Figure 2:
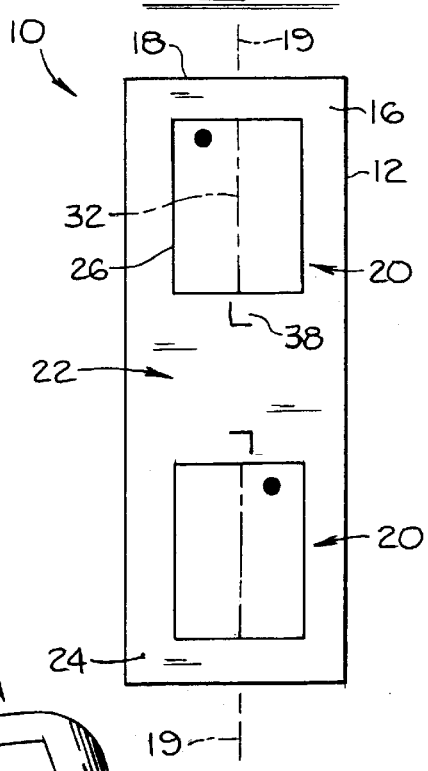
FIG. 2 is a face view of the second side of the bookmark.
Figure 3:
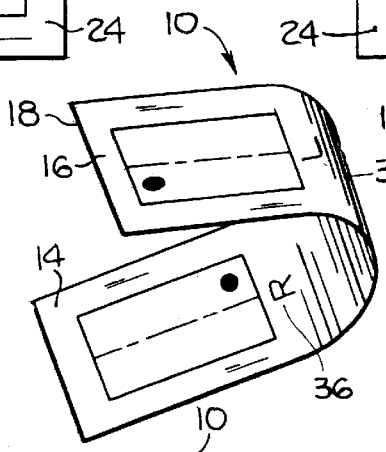
FIG. 3 is a perspective view of the bookmark, bent into curved form to show portions of both sides of the device.

The bookmark is indicated at 10 and is shown best in FIGS. 1 and 2. It includes a plain card, with various markings and indications thereon. This card may be made of any of various materials, e.g. stiff paper, leather, canvas, vinyl, etc. In FIG. 1 the card has a first face 14 displayed to the observer, and in FIG. 2, a second face 16 so displayed. For ease in identification of the elements imprinted on the card, the card is referred to as having an upper end 18.

The bookmark consists of a single such card. In using it, it is placed in the book between facing pages, and the various indications imprinted thereon indicate locations in those facing pages, where the reader left off before.

The card is of elongated rectangular shape, and a longitudinal central axis 19 is shown in the drawing to assist in orienting the card according to the marking thereon.

The card has a pair of icons or sets of indicia 20 on each of opposite sides 14, 16 of the card. These two icons, on each side, are spaced longitudinally apart, to provide a central, transverse space 22 therebetween, and on each side of the card, is a surrounding space 24 entirely surrounding the two icons thereon. The central transverse space 22, and the surrounding space 24, are adapted to accepting promotional material, such as designs, logos, characters, or like materials.

Each icon 20 includes a rectangle 26 of elongated shape, having an outer end and an inner end, and oriented longitudinally according to the longitudinal direction of the card.

Each rectangle represents a book, in open position, displaying facing pages 28, 30 on opposite sides of a central longitudinal line 32 imprinted on the card.

Within each rectangle 26 is a dot 34 at different locations on the different rectangles in accordance with the manner of indicating pages, as referred to below.

Additionally, associated with each icon 20, is one of the letters R, L representing right and left. These letters also are located adjacent the icons according to the position within the book that the stopping location is indicated, as referred to below.

The letters R, L identified 26, 38 respectively, are outside the rectangles, and on any one card are relatively inverted, and positioned closely adjacent the associated rectangles.

In the following description in the placement of the card in the book, the upper end of the book, relative to its position in being read, is considered the upper end.

Figure 4:
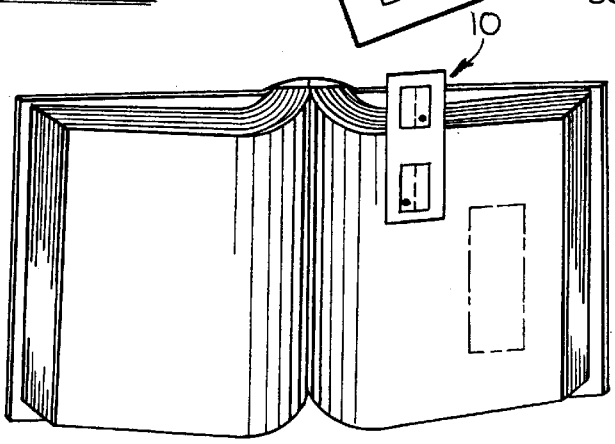
FIG. 4 is a view of the bookmark applied to a page of a book to indicate the location where the reader left off reading.

In one step in using the card, the book is considered open as shown in FIG. 4, and the card is placed on one of the facing pages, such as the right hand page. In this step, the card is so placed that the dot in the icon is at the right hand side, and adjacent the bottom. This indicates that the stopping place was on the right hand page of the book, and the letter R is disposed at the top end of the rectangle. The indication then would be in the lower part of the right hand one of the facing pages.

Figure 5:
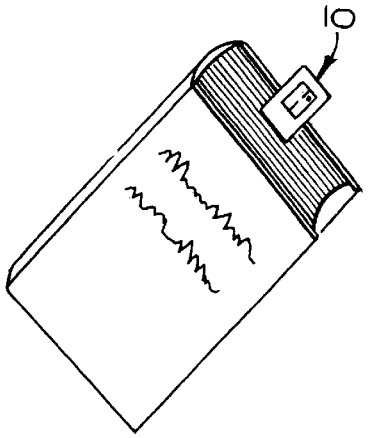
FIG. 5 is a view of a closed book with the front cover exposed and the bookmark of FIG. 4 inverted end for end.

If the stopping place should be in the upper part of the right hand page, the bookmark may be placed on the same page of the book, but inverted longitudinally, as shown in FIG. 5. This arrangement of the card then indicates that the stopping place was on the right hand, lower, part of the book.

The marker need not be placed at the exact line in the book, where the stopping point is, but it falls in the part containing that point and the reader can recognize the stopping place. Thus for stopping points on the same one of the facing pages, e.g. the right hand page, the card need merely to be inverted, end-for-end, with the same face up, for indicating the latter point.

If the stopping location occurs on the left hand page, the card is merely turned over, as shown in FIG. 2, with the same end up, and the dot 34 thereon and the letter L together indicate the stopping place in the book. If the stopping place is in the upper left hand part, the card will be placed as in FIG. 2, but if it occurs in the lower part, the card is merely inverted, end-for-end.

As referred to above, the bookmark consists of a single card. On one side of the card, as first described above, the letter R appears, in either position of the card. In a similar situation, if the stopping place is on the left hand page, the card is turned over, and the letter L is exposed, and is turned end-for-end according to the position of the dot that indicates the stopping place on the upper or lower part of the left hand page.

Ordinarily, when a book is put down from reading, it is laid on the desk with the front side facing up. When the book is again opened, from such a position, the card may be found lying on the right hand facing page as would be normal in handling and reading a book. Such a step would be convenient for the reader and it is not necessary to place the card on a particular side of the book in order to identify the page intended, for the card to be placed thereon, but even if the card is placed on a page on where the stopping place occurs, and covers up the stopping place, the reader can easily determine the stopping place, by observing the letters R and L.

Both letters R appear on one and the same side of the card, and similarly both letters L appear on one and the same side of the card.

As used herein, the dots 34 may be referred as non-descriptive indicators, while the letters R, L and the lines and script may be referred to as descriptive indicators.

Figure 6:
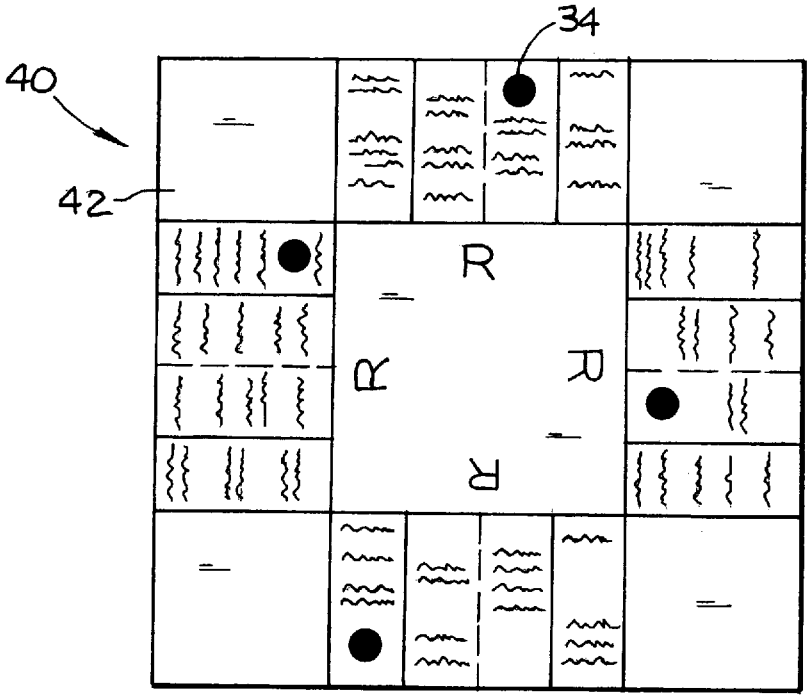
FIG. 6 is a view of a modified form of bookmark therein, lying flat on a table top, with its front cover facing upwardly.
Figure 7:
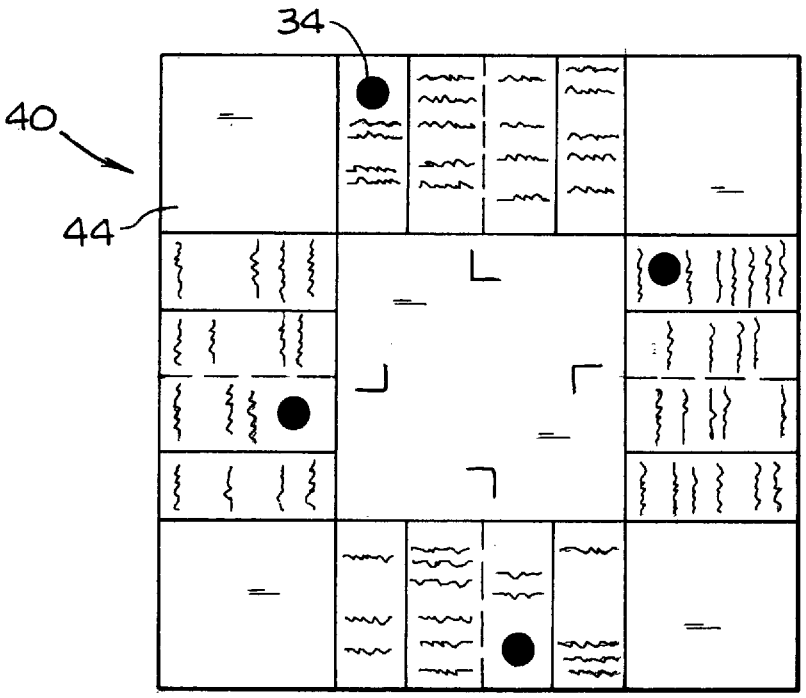
FIG. 7 is a face view, of the opposite side of the modified form of the bookmark of FIG. 6.

Attention is now directed to the modified form of the bookmark, shown in FIGS. 6 and 7. In this case also, the device consists of a single card, indicated at 40. The card has a first side 42 displayed in FIG. 6 and the second side 44 displayed in FIG. 7.

In the case of the first form, FIGS. 1 and 2, the overall pattern of icons is linear, or elongated, in accordance with the simplicity of the device. However, many books have a complex format, including for example two columns of printed material on each page. Such a format can be considered double, and a single dot 34 would not be sufficient to indicate locations, on a full page.

The card 40, FIGS. 6 and 7, may be considered square, i.e., a pair of icons arranged linearly relative to each other in each of relatively transverse directions. This results in each icon representing two pages of the book, and each page including two pages of printing.

The card 40 is square, and a dot 34 appears in each icon on the respective edge of the card.

In placing the card in position, it is adjusted rotationally to locate the desired dot at the top. In this way, one-fourth part of each of the facing pages can be indicated.

It will be noted that the letters R are all on one side of the card, and the letters L all on the other side.

Thus, a common feature of the two forms of bookmark (FIGS. 1–2, 6–7) is a single card having indicators for one of the facing pages of the book on one side of the card, and indicators for the other facing page on the other side of the card.

I claim:

1. A bookmark comprising;

a single card having a length direction corresponding to the top-to-bottom direction of a book, and having an outer end and an inner end, each side of the card having imprinted thereon a pair of icons and each icon having a longitudinal center line, the icons on each side being oriented respectively to the outer and inner ends of the card, the icons of each of the two opposite sides of the card being respectively oriented according to facing pages of the book, the four said icons being disposed on respective ones of the total of four parts on the two sides of the book, each icon including a rectangle representing one of the facing pages of a book, the rectangles being elongated in the length direction of the card, the card includes one non-descriptive dot indicator in each rectangle, adjacent an end of the rectangle, and these non-descriptive indicators on each side of the card being on mutually opposite sides of the corresponding center lines.

2. A bookmark according to claim 1 wherein;

the said non-descriptive indicators on each side of the card are on the same end of the rectangle relative to any given end of the card.

3. A bookmark according to claim 1 wherein;

the card has a descriptive indicator adjacent the inner end of each rectangle, outside the rectangle, the descriptive indicators include the letters R, for right, on one side of the card, and the letter L, for left, on the other side, and the indicators are oriented for reading the upper one when the card is placed longitudinally leading forwardly from the reader, each side of the card including two pairs of icons, and the pairs are arranged transversely relative to each other.

4. A bookmark according to claim 3 wherein;

each card includes letters R or L, and all of the letters R are on one side of the card, and all of the letters L are on the other side of the card.

* * * * *